US007060000B2

(12) United States Patent
Carlson

(10) Patent No.: US 7,060,000 B2
(45) Date of Patent: Jun. 13, 2006

(54) GAME AND EXERCISE DEVICE AND METHOD

(76) Inventor: Carl A. Carlson, 717 Station Ave., Apt. B-14, Bensalem, PA (US) 19020

( * ) Notice: Subject to any disclaimer, the term of this patent is extended or adjusted under 35 U.S.C. 154(b) by 274 days.

(21) Appl. No.: 10/260,244

(22) Filed: Sep. 30, 2002

(65) Prior Publication Data

US 2003/0073541 A1 Apr. 17, 2003

Related U.S. Application Data

(60) Provisional application No. 60/329,471, filed on Oct. 11, 2001.

(51) Int. Cl.
*A63B 22/00* (2006.01)

(52) U.S. Cl. ..... 482/1; 482/900; 434/250; 434/258

(58) Field of Classification Search ..... 482/1–9, 482/900–902; 84/464 R; 434/247, 258, 434/250

See application file for complete search history.

(56) References Cited

U.S. PATENT DOCUMENTS 2,605,557 A * 8/1952 Deventer ..... 434/250
5,584,779 A * 12/1996 Knecht et al. ..... 482/8
5,597,309 A * 1/1997 Riess ..... 434/258
6,110,073 A * 8/2000 Saur et al. ..... 482/8
6,410,835 B1 * 6/2002 Suzuki et al. ..... 84/464 R

* cited by examiner

*Primary Examiner*—Glenn E. Richman
(74) *Attorney, Agent, or Firm*—Dann, Dorfman, Herrell and Skillman, P.C.

(57) ABSTRACT

A game board device for directing body movements in games, exercise, or physical therapy. It employs a support frame of side-by-side modular units of relatively the same size and shape supporting a continuous matrix of contact surfaces supported in a common plane. The contact surfaces in the adjacent frames are arranged in a coordinated matrix of adjacent surfaces that are illuminatable in various colors. The contact surfaces are illuminated normally one at a time so as to cue sequential steps in a random pattern and at varying speeds in a game or predetermined patterns and adjustable speeds in exercise or therapy. Control of the sequential illumination may be manually or by a program by manually operated device or by computer. It is preferred that the individual frames be hindged to permit folding for storage and transportation.

30 Claims, 4 Drawing Sheets

GAME AND EXERCISE DEVICE AND METHOD

Applicant claim the benefit of priority of U.S. Provisional Application Ser. No. 60/329,471, filed on Oct. 11, 2001.

FIELD OF THE INVENTION

The present invention has to do with a system useful for games as well as for exercise routines. In its simplest form it provides an array of surfaces, either regularly or randomly distributed sufficiently proximate to one another that an individual may reach all, or many, of the surfaces with his hands or feet. The object of the game or exercise is to move from one to another of the surfaces as they are illuminated, in succession with his feet, or hands, or both. The movements in a game might be random testing of the skill and agility of the player. In exercise or dance, the movements might be repetitive, but subject to change in a predetermined pattern, for example.

BACKGROUND OF THE INVENTION

In the prior art, systems for teaching dancing have been devised using either fixed or movable marks or footprints arranged, or capable of arrangement into in the pattern of the dance steps to be followed by the feet of a student learning the dance. Games, such as hop scotch, have been devised using a pattern to designate hand or foot positions to be successively assumed. Alternatively, a contortionist game, using a game board with numbered positions for hands or feet, has been played by randomly selecting numbered successive sites for positioning a hand or foot by a spinning pointer or by dice toss. However, when using such prior art, there is normally no pace set for the user, but movement is in response to random directions, obtained sporadically, often by the player himself. In the case of dance patterns, music may direct movement at some stage, but the user must know the pattern to follow.

The present invention differs in that individual surfaces are designated right at the specific surface selected. A preferred method of designating surfaces is by light illuminating a selected surface, or part thereof. The actual selection of sequential surfaces is preferably not done by the player, but might be done by another person manually or automatically by switching equipment. In fact, it could be preprogramed in advance. Each lighted surface, preferably selected externally of the surface, is lighted by means of a source remote from the surface, at the surface, or even internal of a surface-supporting structure.

Alternatively, instead of illumination some other means, such as aural means in the form of a bell or buzzer, or the like, located at each surface, may be employed. Again means of switching on the aural device in a manner similar to the lighting in a way similar to switching the lighting may be employed.

More specifically, the present invention relates to a device for directing body movement in games or exercise in which at least three members having contact surfaces are adapted to be arranged in a coordinated pattern. Illumination means is provided to separately and selectively illuminate each of the respective contact surfaces, no more than two at a time, and means is provided to control the sequence of illumination. As a consequence, a player may try to move his selected body extremities to an illuminated surface as the surfaces in turn become illuminated.

The present invention also relates to the concept of sequential illumination of tiles which are made of rugged, wear-resistant material, and preferably are of different colors. It also employs translucent tiles to permit illumination from below or within the tile. It also includes the concept of supporting tiles in a rigid frame to provide a game board. It also permits dividing a game board into parts, each of which employs a permanent array of tiles in a rigid frame means, which parts are hinged together for folding into a more compact package for convenience in storage and for portability.

However, the invention is not limited to a framed rigid array. The illuminated contact surfaces may be separate pieces capable of being placed on the ground or a floor but somehow capable of having their positions identified so that they may be found when they are selected for illumination. This may be done by providing each contact surface with on-the-spot lighting, preferably internally, but otherwise fixed relative to each surface. Alternatively, it may be done by using a predetermined pattern so the surfaces are maintained in a prescribed relationship with one another and have one or more remote light sources for each discrete contact surface. Otherwise, it may be done by using remote illuminating means which, for example, may use a computer driven positioning means to find and remember the various positions of contact surfaces and then permit either manual or automatic selection of any of the same positions in random or patterned selection sequences and patterns.

The invention also consists of a method of use of surfaces which may be positioned relative to one another to afford reasonable ease in stepping from any tile to any other in an array or in a partial array. The pieces which provide supporting surfaces for feet or hands, need not be tiles of such, but are referred to herein frequently as tiles. Natural stones, or markings on a floor, for example, may be arranged in a configuration for use as a game or exercise which then is illuminated by a light source which moves from surface to surface as a cue for movement of the player. More specifically, the invention relates to a game or an exercise which employs members having contact surfaces which can be sequentially illuminated in a controlled manner, no more than two at a time, to provide a cue for a player to make a move. Changing the illumination from one contact surface to another provides a cue for the player to move on and make contact with that newly illuminated surface or surfaces. The movements are random and unpredictable to test the skill and coordination of a player. In exercise or dance applications the movement may be repetitive and the timing uniform between movements or simulating a rhythm with varied timing between movement.

BRIEF DESCRIPTION OF THE DRAWINGS

For a better understanding of the present invention reference is made to examples of embodiments of the invention in the following drawings.

Figures 1, 2:
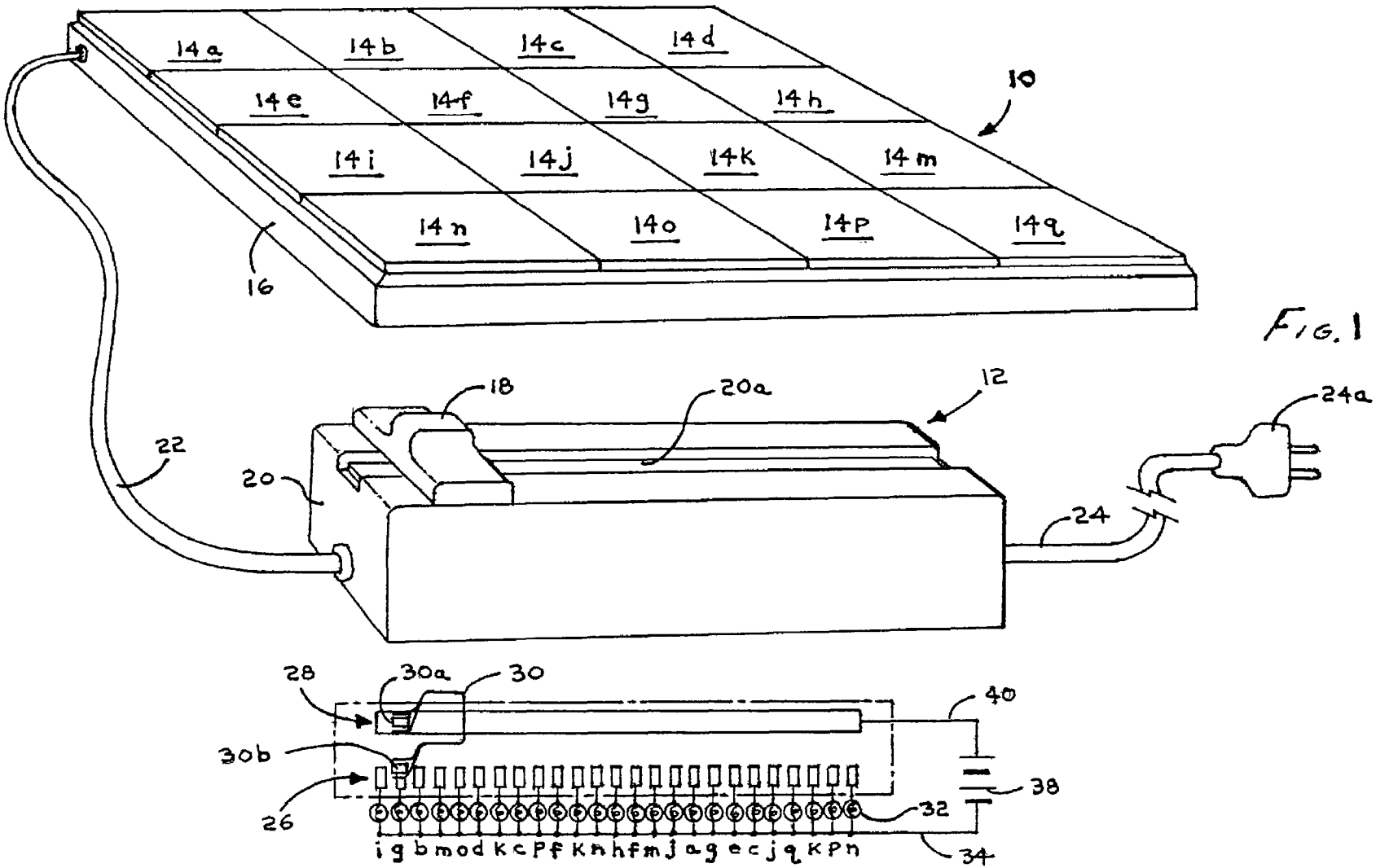
FIG. 1 shows in perspective and somewhat schematically a preferred embodiment of the invention.
FIG. 2 is a schematic drawing of the circuitry employed in the system of FIG. 1.

Referring first to FIG. 1, a game board array 10 and a switch control 12 for sequentially illuminating the surfaces of individual contact members of the game board are shown. In this embodiment the game board is shown to be a matrix of square tiles which may be, for example, 8 inches or larger on a side. The size is determined by a number of factors including the size of the players and their extremities used to play the game. There are 16 tiles 14*a*, 14*b*, 14*c*, 14*d*, 14*e*, 14*f*, 14*g*, 14*h*, 14*i*, 14*j*, 14*k*, 14*m*, 14*n*, 14*o*, 14*p* and 14*q* in this configuration. They are all supported relative to one another by a frame 16, preferably made of insulating material, such as wood or a molded rigid plastic. The tiles and supporting frame need to be constructed of material which is rugged enough to resist the wear and tear and impact of people standing or even jumping on the individual tiles. The tiles are also preferably colored and have a light source for each tile so that the individual tiles can be selectively illuminated. In this preferred embodiment the tiles are also translucent and illuminated from inside or beneath the tile so that it is advantageous to use material easily fabricated or machined to provide the desired space for the required light source to permit good distribution of light through the tile to its surface. A material that is suitable is polycarbonate resin.

In order to control switching of the light sources to illuminate the tiles in a desired sequence some sort of switching means is required. The switching means 12 is a highly specialized device which permits switching in a predetermined sequence by moving a slide 18 from one end of slot 20*a* to the other. Random movement in either direction can vary the sequence. In this embodiment movement of the slide is limited by the slot to the direction of elongation of enclosing box 20. Cable 22 provides separate wires or connectors for each light source, and, as will be discussed in connection with FIG., 2, a separate common connection to all light sources. Cord 24 may be a conventional two wire electrical cord for connecting the system to power through an ordinary household power outlet using a conventional plug connector 24*a*.

FIG. 2 is a schematic diagram showing a linear planar commutator and parallel slip ring within and at the bottom of the box parallel to and beneath the slot 20*a*. Connecting sequentially selected commutator segments one at a time with the slip ring is a conductive connector structure 30. Connector 30 is terminated at each end in conductive roller terminals 30*a* and 30*b* rotatably supported on connector structure 30 and spring loaded into conductive contact with slip ring 28 and commutator 26, respectively. The entire connector structure is, in turn, attached to and mechanically supported by slide 18. The slide preferably slidably engages the box 20 along the edges of slot 20*a* to guide its movement along the slot and, in turn, the movement of the conductive connector structure 30 with its rollers 30*a* and 30*b* spring biased into good electrical contact with linear slip ring 28 and commutator 26, respectively. The slip ring and commutator form a sort of track parallel to the slot 20*a*.

The conductive connector structure 30 is mechanically supported on and moved by slide 18 by hand, or by some type of motor mechanism if desired. The position of the slide determines which tile is illuminated at any given time. Each tile has its own light source, which is internal or beneath the tile in the structure of FIG. 1. In practice, there may be more than one light source in parallel or otherwise arranged to be illuminated simultaneously. Light sources for all tiles are schematically represented in the circuit diagram of FIG. 2 with some sources shown more than once. It will be appreciated that the light sources schematically shown in row 32 in FIG. 2 are each intended to represent the light source for a single tile. In another version of the invention, each tile may have multiple light sources which are engaged separately by the search control 12. A matrix includes the parallel rows of slip ring 28, commutator segments 26 and light sources 32, and the serially connected commutator segments and light sources define columns designated by a letter corresponding to the letter suffix of the tile or square surface which will be illuminated when the commutator segment of the column is contacted by the roller 30*b* of the conductive connector structure 30 and provides an electrical path from slip ring 28 through roller 30*a*. As shown schematically in the circuit diagram all of the light sources are connected to common conductive lead 34 which is connected to power supply 38, here represented by a battery. Power supply 38 is, in turn, connected back to the slip ring 28 by conductor 40.

In practice, a battery may be used if desired, but the system shown in FIG. 1 employs conventional house electrical power system and conductors 34 and 40 are included in a two wire cord or cable connection completed to a conventional power outlet through conventional plug 24*a*. Cable 22 includes individual wires for connecting the light source at each of the tiles in the game board array to one or more commutator segments. Cable 22 also includes the wire connection between the common connection 34 to the other side of the light sources from that connected to the commutator segments and the power source 38.

In the system shown in FIG. 1 it will be appreciated that cable 22 contains wires which must extend between the tiles in the array 10 and the switch control box 12, and wire 34 must extend through the box and through cord 24 which in practice will often be made much longer than suggested by FIG. 1. It will be understood that FIG. 2 is a schematic electrical diagram to aid in understanding how circuit elements are interconnected. In practice the light sources are not arranged as a row in a matrix as shown in FIG. 2, but are distributed to all of the tiles in array 10 and the short connections shown in FIG. 2 are actually long enough to extend between the light sources in the array 10 and the commutator and slip ring connections in switching means 12.

Figure 3B:
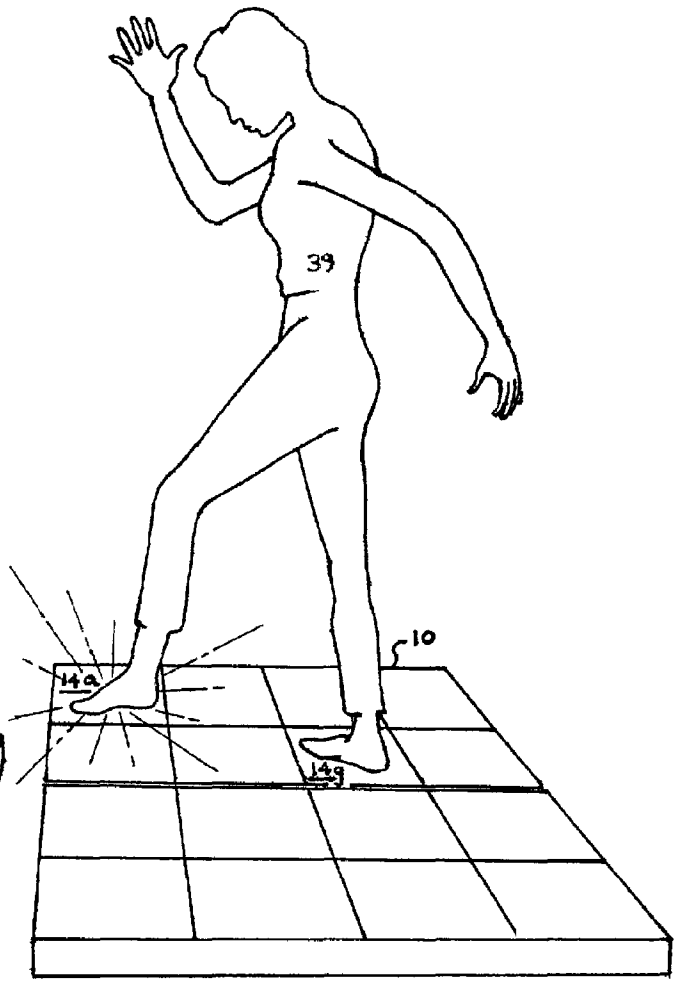
FIGS. 3*a* and 3*b* are schematic presentations showing a phantom figure of a player moving from one position in FIG. 5*a* to the next position in FIG. 5*b* in response to light stimulus.
Figure 3A:
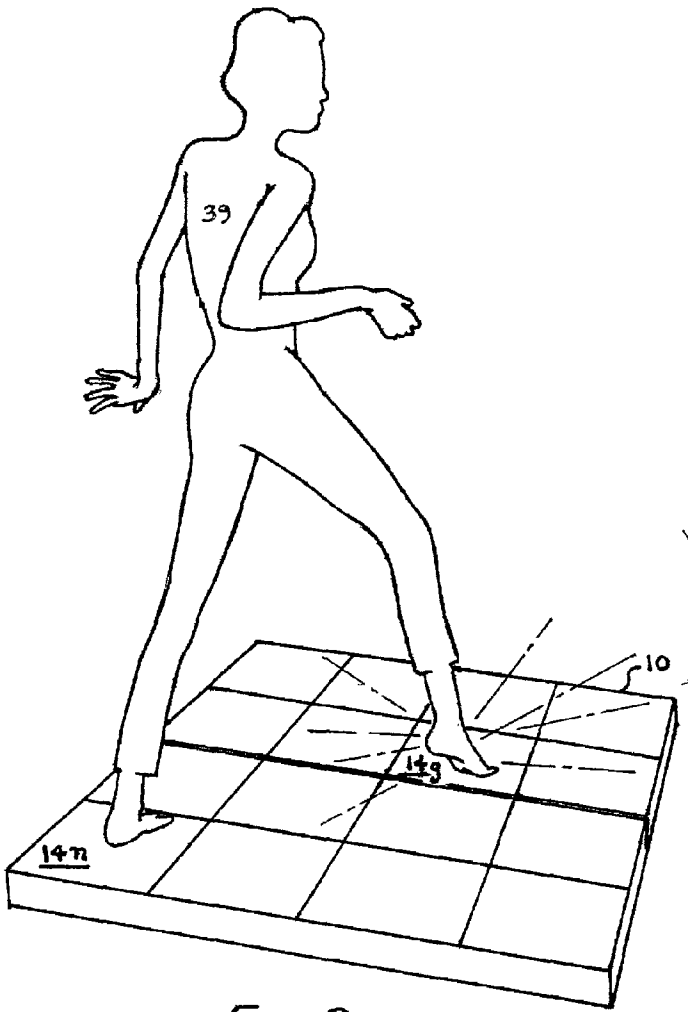

In use as a game, a single player, shown as a "figure in phantom" 39 in sequential position drawings FIGS. 3*a* and 3*b* tries to step from one lighted tile to another as the tiles are illuminated in a random sequence, not known in advance to the player. In the embodiment of the invention shown in FIGS. 1 and 2, the slide, if moved one way or the other, will change illumination of the tiles in a fixed sequence. However, the sequence may be changed by randomly reversing direction of the slide. The speed can be increased or decreased depending upon the level of skill of individual players. Games can be varied by allowing play for a fixed period of time and counting the number of "misses" of each player for that set time. Alternatively, players may be timed until a miss occurs and the times to a miss compared for each player.

The movement of hands from one illuminated tile to another provides a variation in the way the game is played.

With the use of hands the board size can be reduced by reducing the tile or other contact area size. Also a variation in the game might be to light two tiles at a time, thus suggesting a hop coordinating two possibly unrelated foot or hand movements, or alternatively two successive fast movements of the individual feet or hands.

Figure 4:
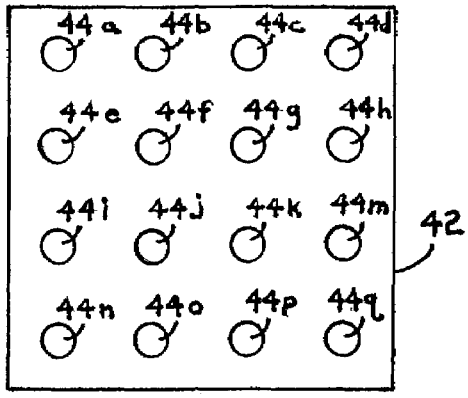
FIG. 4 shows a plan view from above of a modified panel of switch controls arranged in a matrix which corresponds to the matrix position of the game board.

FIG. 4 shows a variation 42 in the switch controls for the game board array of FIG. 1. It is a simple push button array 42 which has push buttons 44*a* to 44*q* arranged in a matrix for actuating switches, preferably with the push buttons having corresponding positions to the tiles having the same suffix in the array 42 of FIG. 1. Each push button actuates a switch in series with the light source for a tile having the same suffix as that of the push button, each of which circuits has a power source in circuit that cause the associated light source to be energized. Thus this system allows truly on the spot random selection of sequences of lighting of the game board matrix requiring separate movements with each change of lighting. It should be understood that the matrix of FIG. 4. is a replacement for the switch box 12 of FIG. 1. The switch matrix uses similar circuitry with individual switch contacts corresponding to individual commutator bars of FIG. 2. The switch contacts like the commutator are remote from the light sources and may use a similar circuit arrangement with separate lines connected to the light sources and the other contacts being connected together and to a power line, similar to conductor 40.

Figure 5:
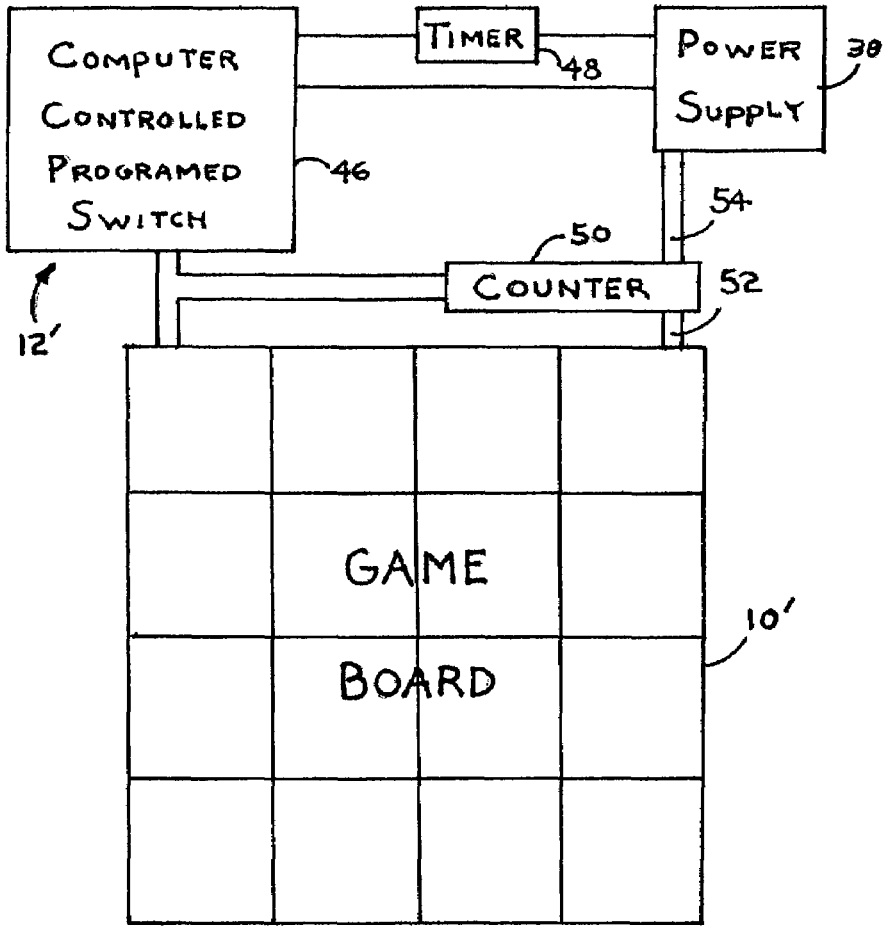
FIG. 5 is a block diagram of a computer controlled version of the invention.

FIG. 5 shows schematically an even more precisely controlled system for the same or a similar game board array 10'. A power supply 38' provides power to the system. Switching is provided by a computer controlled switch means 12' which provides an effective switch for each light source as before. However, in this case the switches may be closed in a predetermined sequence, or a selection of pre-programmed sequences and at different rhythms as desired. A timer may be separately included in series with the common connection for all switches to the power supply and to cut off the program after a pre-set time. Alternatively the timer may be included in the computer which in any event may include manual selection means to choose programs and for other purposes. A counter 50 may also be included in the line, or be magnetically coupled to the line which will carry successive pulses as switches are turned on. A coincidence circuit may be included in the counter with sensors detecting contact by the foot of the player at each tile. This will require individual connections through a multi-conductor cable. It may also be desirable to supply separate power lines 52 directly to the counter 50, if power would otherwise be interrupted when a count display is provided. Means to automatically reset the counter upon a signal from the program computer 46 may also be desirable, or manual reset may be employed.

Computer control, of course, involves many techniques well known in the art. These involve use of various forms of memory to provide either a repetitive program of switching or a random program. A random program could use some sort of random numbered generator dealing only with the number of surfaces to be contacted. Memory could be supplied by built in "hard wired" sequencing or it could be more conveniently controlled by software. The selected designated switches are to reposition lighting by whatever regular or random sequence of lighting were selected.

Figure 6:
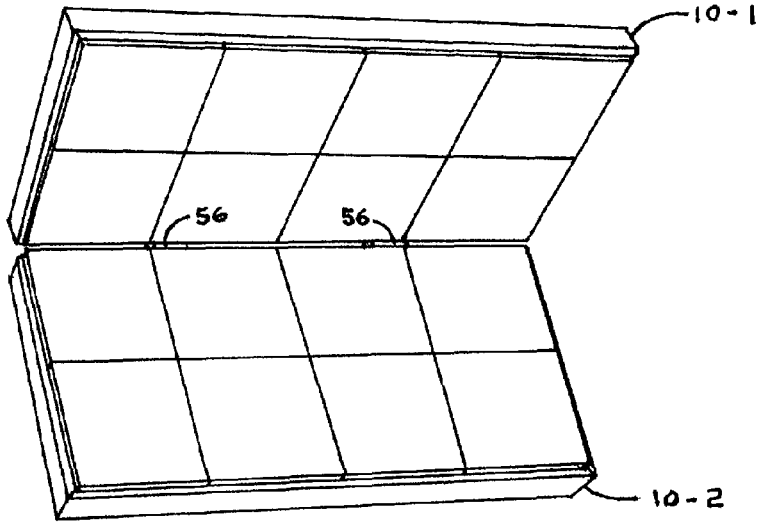
FIG. 6 illustrates in perspective a game board of the type shown in FIG. 1, which however is capable of being folded for storage or portability.

It will be appreciated that the tiles are just one form of members providing contact surfaces which may be used with the invention. Tiles may be made in various other shapes to fit together in a game board. Hexagonal tiles of uniform size permit compactness but present irregular edges which may be filled in by partial tiles made for the purpose to complete a shape conforming to a rectangular frame. Whatever the shape the frame must solidly support the tiles in view of their use. Patterns of circular or oval tiles may result in gaps which may be filled in with non-illuminated background material. A circular game board could be used and provided with conforming tiles of arcuate shapes, for example. However, and in many applications in which adjacent compactness is desirable rectangular shapes are usually more practical. Rectangular tiles of a fixed size may be particularly satisfactory to work with where a portable game board is desired. The pattern used in FIG. 1 is convenient for this reason and the supporting frame for the tiles may be divided, for example, into two parts 10-1 and 10-2 as shown in FIG. 6 and hinged for folding using two hinges 56 as shown or using other conventional arrangements to provide greater compactness for storage and more convenient portability.

Figure 7:
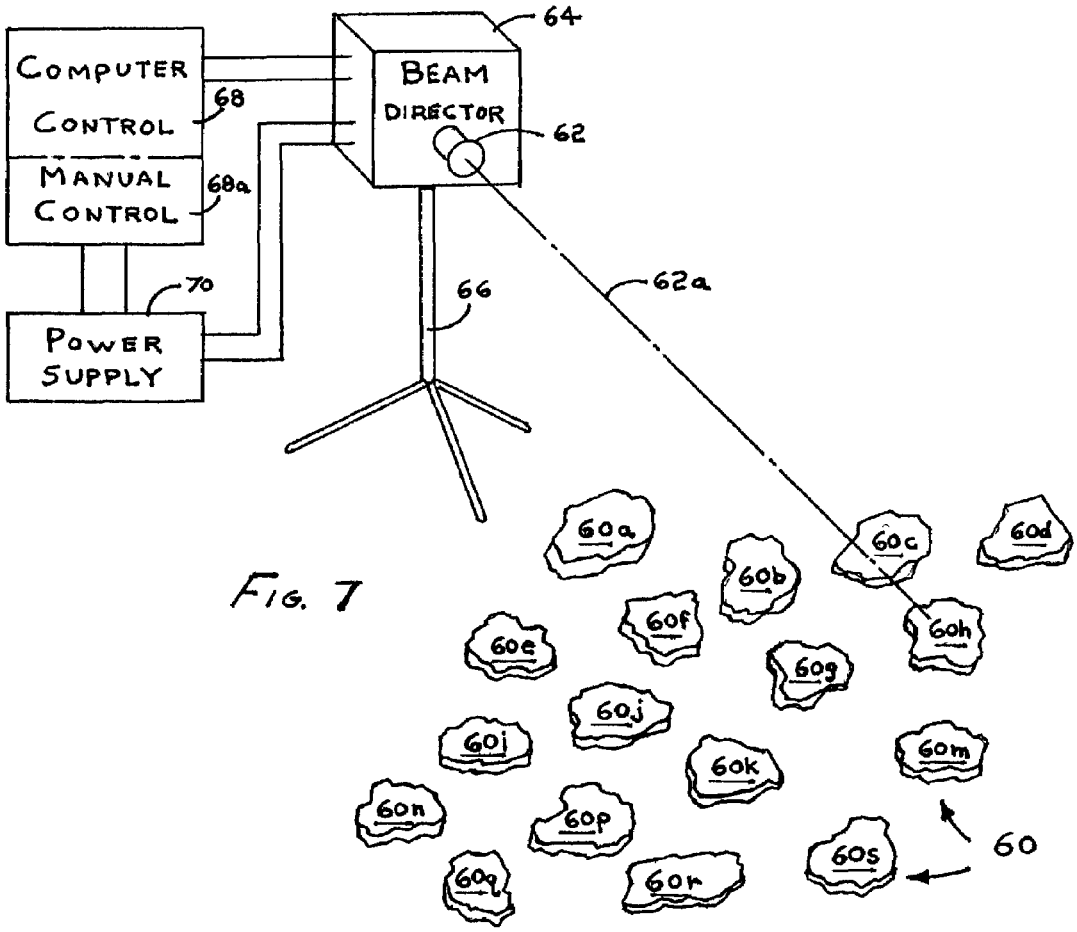
FIG. 7 illustrates a further embodiment of the invention involving discrete members providing contact surfaces which are not held together in use but each is connected to switching means enabling selection of surfaces to be illuminated.

FIG. 7 represents an application of the invention which, instead of employing the fixed array within a rigid frame of some sort as a game board or conveniently portable and storable device, may use completely irregular stones, or manufactured pieces, preferably with flat contact surfaces. The stones 60 can be arranged in a pattern, which is roughly a matrix, but more irregular as shown in FIG. 7. There are 17 independent stones, in this case, having no connection to each other, other than earth on which they are placed. The stones, nevertheless, need to be ordered in fixed accessible arrangements for a player in order to be useful in playing a game or other activity which requires random or patterned lighting of the surface of various stones in the array. As shown, the stones are numbered 60*a*, 60*b*, 60*c*, 60*d*, 60*e*, 60*f*, 60*g*, 60*h*, 60*i*, 60*j*, 60*k*, 60*m*, 60*n*, 60*p*, 60*q*, 60*r* and 60*s*. The use of 17 stones simply illustrates the randomness and disconnection of this particular form of the invention. The stones are illuminated by a moveable light source 62 which projects a beam 62*a*, shown as presently impinging surface 60*h*. The beam is created by a commercial spotlight which can be highly focused, or, if necessary, with such a source and lens or other focusing means to direct it coherently to a particular surface. A mechanism 64, labeled "beam director," which includes an X-Y type drive arrangement to reposition the light source 62, so that it can contact any one of the surfaces in the array. The beam director structure is shown supported on a tripod 66, but preferably may be removably supported on a more permanent mounting, such as a post fixed in the ground so that it can be returned to its exact position when remounted. Such a precaution will maintain its relative position from time to time in use and permit computer memory information to continue to be used. The beam director is driven by a suitable motor drive under the control of a computer control 68 suitably coupled to the beam director 64. Both computer control and the beam director are connected to power supply 70 which supplies power to the motor control devices which position the light source, as well as providing the power for illuminating the light source 62. The computer control, preferably, includes a manual control 68*a*, permitting an operator to move the source to project its beam in sequence from the surface of one stone to another. When illumination of a particular stone is satisfactory, drive position information indicating that position may be placed in the memory of a computer. Thereafter, the computer may be returned to any of the stepping positions through memory. A program may then be provided automatically stepping the projected beam onto surfaces of the different selected stones to illuminate them in a predetermined sequence. This can be carefully timed so that the intervals of movement are uniform. Uniform timing may allow a game, for example, to be played for two minutes, or another selected time period, and permit one or more monitors, who preferably would be human to count the number of misses in that preselected time in order to give each player a score. Other ways of using the device for game purposes, of course, are possible and have been suggested or would be obvious to the man skilled in the art with some thought. Programs for automatic illumination of stones in selected sequences can be provided. Also, once selected and identified, manual selection of the positions at random by a human operator can be accomplished.

The embodiment of the invention shown in FIG. 7 is itself subject to various modifications already suggested. One such modification is to provide each of the stones with its own illuminating spot light. In such an arrangement the spot lights are fixed and do not have to be moved around, minimizing the amount of equipment required. Furthermore, the spot lights for the individual rocks may be connected in simple switch arrangement, like that of FIG. 1 or that of FIG. 3. In the case of FIG. 3, the arrangement of switches can be a duplicate of the positioning of the stones, so that the controls operator knows which surface is illuminated by the positions of the switches. It is also possible to have individual tiles which might be irregularly shaped because there is no need for the tiles to be rectangular or any other conforming shape when distributed along the ground or the floor, out of direct contact with one another. Even if in contact with one another, to some extent, the same reasoning applies. Finally, it is possible to use light sources under or within the surface contact member as in the tiles of FIG. 1. The problem, of course, is providing individual electrical connection to each of the members providing a contact surface. While it may be possible to use a radio link, it would also seem possible to use individual electrical cords, which allows the light source within the individual tile or other contact surface member be connected into a circuit similar to the one suggested in FIG. 2. Again with the understanding that the lines as shown in FIG. 2 as short links, thereby immediately become very long, and possibly of variable length with the contact surface member depending on their relative positioning.

In addition to use as a game, the invention can be used for an exercise or physical therapy device. The variability of time either using a manual system or a computer control system is significant when the device is used as a device for physical therapy and movements may need to be relatively slow by a person who is injured or recovering from disease. The concept of following the lighted surfaces in a fixed pattern is retained, but instead of random unanticipated movements, a regular pattern of repeated movements might be guided, and a fixed rate or a rhythm can be provided, particularly where a computer is employed. Dance steps might be taught as well, although a larger number of tiles might be needed as the tiles are lit one at a time over a wider area. Computer control for the sake of providing varying time is attractive in order to allow more flexibility with timing and yet to achieve greater precision. Such precision may be particularly desirable in teaching dancing where not only the rhythm is an important factor, but the overall pace of the dance music can be speeded up or slowed down depending at what stage it is being used in the teaching process.

Being able to adjust the pace may also be important in therapy, for example, increasing the pace as the patient is able to move faster. The system can allow for variable timing between steps to simulate dance step timing or switching can increase the pace of timing generally in a game of skill. The nature of the switches used and the means of control of the switches or simulated switching by computer are all conceived to be able to be selected from great variety.

Countless variations in the size, shape, number and relative arrangement of the members providing the contact surfaces are within the scope of the invention.

I claim:

1. A game board device for directing body movement in games or exercise comprising, at least one support frame, all such frames employed together defining a suitable game board of limited area;

a plurality of contact surfaces of relatively the same size and shape and providing part of modular units of generally rectangular shape and of generally the same size supported side by side relative to one another by one another within and filing each support frame employed, in a coordinated matrix pattern so that all the contact surfaces in each frame lie generally in a common plane and provide a continuous matrix of contact surfaces sufficiently close to one another that a player may move a selected body extremity from any contact surface in the matrix to any other without stepping up or down out of the general common plane, and illumination means which is normally-off for each module to separately and selectively illuminate each of the respective contact surfaces individually to cue movement to contact a newly illuminated contact surface by a selected body extremity, and switching means to selectively connect the illumination means for various contact surfaces to a power source to control the sequence of illumination of a selected contact surface whereby a player is cued to move his selected body extremities to each newly illuminated contact surface as different selected contact surfaces in turn become illuminated and to turn off the illuminated surface at a predetermined time after contact has been made to keep dark the contact surfaces when they are not immediate in play.

2. The device of claim 1 in which there are a plurality of support frames which fit together and can be secured relative to one another so that positions of contact surfaces remain fixed but may be separated and stacked together relative to one another for compactness and portability when not in use.

3. The device of claim 1 in which the rigid frame members are hinged together to permit folding and unfolding to provide the continuous matrix of contact surfaces.

4. The device of claim 1 in which separately energized illumination means is incorporated within each modular unit, the contact surfaces of which are each arranged to be illuminated by its illumination means principally and distinctly that contact surface.

5. The device of claim 1 in which the contact surface of each modular unit displays one color with at least two different colors being used and distributed around the contact surfaces.

6. The device of claim 5 in which the various contact surfaces, when illuminated, display many different colors distributed around the contact surfaces with contact surfaces of the same color being separated from each other.

7. The device of claims 6 in which separate illumination means are beneath the contact surfaces which are translucent to display the color of the illumination selected for that contact surface.

8. The device according to claim 1 wherein the means to control the sequence of illumination is provided with switching means enabling the sequence and timing of illumination of contact surfaces to be remotely controlled.

9. The device of claim 8 in which the switching means comprises at least as many individual manually actuated switches as there are illuminating means arranged together for the convenience of human operation.

10. The device of claim 9 in which switching means include individually manually controlled switch actuators arranged in a pattern corresponding to the configuration of the contact surfaces, with each actuator arranged in a relative position corresponding to the position of the contact surface in the pattern which it will illuminate.

11. The device of claim 10 in which the configuration of contact surfaces and of actuator for switching means, respectively, is a rectangular matrix having positioned switch actuator means in the same relative positions in regular rows and columns as the contact surfaces they are used to illuminate.

12. The device of claim 8 in which the switching means involves switches arranged to be sequentially activated by a moving actuator.

13. The device of claim 12 in which the moving actuator is capable of various patterns of movement.

14. The device of claim l2 in which the moving actuator is confined to a specific path but can be moved in either direction along the path.

15. The device of claim 14 in which the moving actuator is a slide confined to linear movement along a linear array of switches.

16. The device of claim 12 in which the moving actuator provides a common switch contact completing a circuit through switch contacts to complete a power circuit to illumination means which successively light various contact surfaces.

17. The device of claim 16 in which the actuator includes a sliding conductor bridging a continuous conductor serving as a common electrode for multiple switches and a commutator providing separate contacts for each means of illumination.

18. The device of claim 1 in which the game board is divided into parts which may be folded relative to one another for portability and storage.

19. The device of claim 1 in which at least one illumination means is incorporated as part of the structure associated with each contact surface.

20. The device of claim 19 in which the illumination means is provided beneath each contact surface and the surfaces are translucent.

21. The device according to claim 1 wherein the illuminating means is controlled by computer in such a way that the illumination switching will be changed as directed by a computer program.

22. The device according to claim 21 wherein the switching means is controlled by a computer wherein the program will randomly change the sequence of illumination.

23. The device according to claim 21 wherein the switches for the illuminating means may be set to activate in a repeatable sequence and that sequence may be changed to produce other desired sequences by the program.

24. The device according to claim 23 wherein said control means is adjustable to vary the frequency of change.

25. A method of game playing involving stepping from one illuminated contact surface to another where the contact surfaces are arranged in a repetitive pattern fully covering a predetermined game surface area in a common plane compactly so that the player can step from any contact surface to any other in the game area with ease, and the contact surfaces being illuminated one contact surface at a time to provide the player with the only clue as to where he should next step comprising;

lighting a first contact surface as the cue to where the player should step;

lighting a next contact surface as the cue to where the player should next step, while discontinuing the lighting of the previous surface, repeating the second step of the process for as many steps as desired by lighting sequentially different contact surfaces at random and discontinuing the lighting of each lighted contact surface when the player leaves it for a total number of successive steps onto lighted contact surfaces as desired.

26. The method of claim 25 in which the rate of lighting changes is varied during play and the pattern of changes is varied for each player.

27. The method of claim 25, in which the player is graded on the number of hits or the number of misses in a total number of sequential contact surface illuminations during the period of the game.

28. A method of providing therapy involving moving alternative body extremities from one illuminated contact surface to another where the contact surfaces are arranged in a repetitive pattern fully covering a predetermined surface area in a common plane sufficiently compactly that the patient can move alternate body extremities from one contact surface to another over a selected area with ease, comprising, placing the patient receiving therapy in a position to contact the contact surfaces alternating with a selected pair of extremities, illuminating a first contact surface to cue placing a selected extremity on that illuminated surface;

lighting a next contact surface to cue the patient to place his other selected extremity there while extinguishing the light on the first contact surface, providing a sequence of lighting of contact surfaces, and extinguishing the lighting of the last previously contacted surface to cue movement of the patient for the therapy alternating movement of the selected extremities, and continuing the process for a period prescribed for the therapy while timing successive lighting cues at rates prescribed by the therapy to achieve the desired exercise results.

29. A device for directing body movement in games or exercise comprising, a game board providing generally planar contact surfaces arranged in a coordinated pattern for hand or foot contact which contact surfaces are sufficiently large to accommodate the playing extremities of an anticipated largest player so that it is possible for players to contact each contact surface with a hand or foot without also contacting an adjacent contact surface, illumination means to separately and selectively illuminate each of the respective contact surfaces, and means to provide and control the sequence of illumination of the contact surfaces, so that newly illuminated surfaces are lighted no more than two at a time and extinguished after the player contacts the lighted area in order to avoid confusion, whereby a player is directed to move his selected body extremity to a newly illuminated contact surface as the surface, in turn, become illuminated.

30. The device of claim 29 in which the contact surfaces are part of a game board and have fixed positions specific relative to one another on the game board.

* * * * *